US005500971A

United States Patent [19]

Springmann

[11] Patent Number: 5,500,971

[45] Date of Patent: Mar. 26, 1996

[54] HAND-SCRUBBING BRUSH

[76] Inventor: Hartmut Springmann, Bichlerstrasse 7a, D-7530 Pforzheim, Germany

[21] Appl. No.: 295,830

[22] PCT Filed: Mar. 19, 1993

[86] PCT No.: PCT/EP93/00667

§ 371 Date: Sep. 9, 1994

§ 102(e) Date: Sep. 9, 1994

[87] PCT Pub. No.: WO93/19658

PCT Pub. Date: Oct. 14, 1993

[30] Foreign Application Priority Data

Mar. 28, 1992 [DE] Germany ..... 42 10 301.0

[51] Int. Cl.[6] ..... A46B 13/02

[52] U.S. Cl. ..... 15/23; 15/97.1

[58] Field of Search ..... 15/22.3, 23, 24, 15/28, 29, 97.1; 601/112, 114

[56] References Cited

U.S. PATENT DOCUMENTS 1,795,869 3/1931 Lee ..... 15/23

3,252,175 5/1966 Pedersen ..... 15/22.3

3,813,720 6/1974 Sylvie ..... 15/23

4,027,348 6/1977 Flowers et al. ..... 15/22.1

FOREIGN PATENT DOCUMENTS 2846739 5/1980 Germany ..... 15/22.3

*Primary Examiner*—Edward L. Roberts, Jr.

*Attorney, Agent, or Firm*—Michael J. Striker

[57] ABSTRACT

A hand-scrubbing brush has drive mechanism, a housing accommodating the drive mechanism, the housing having a kidney-shaped profile, a plurality of rotational bodies equipped with bristles arranged rotatably in one narrow side of the housing along a line adapted to a kidney shape of the profile, and a mechanism for transmitting movement of the drive mechanism to the rotational bodies so as to drive the rotational bodies in form-and force-locking manner.

15 Claims, 2 Drawing Sheets

HAND-SCRUBBING BRUSH

BACKGROUND OF THE INVENTION

The present invention is based on a brush suitable for the care of the human body.

A brush of this type which is preferably intended for the cleansing or scrubbing of finger-nails and toe-nails within the area of the nail beds has become known from the prior published German patent specification DE 37 27 649 C1. This type of embodiment, however, is unsuitable for being utilized as a hand scrubbing brush, because there is only provided one plate-shaped brush member with the aid of which the cleansing or scrubbing of the whole hand is rather strenuous and time-consuming.

SUMMARY OF THE INVENTION

It is the object of the invention, therefore, to provide a hand-scrubbing brush which has a mains-independent motor drive and permits a cleansing or scrubbing of the entire surface of the hand inclusive of the finger-nails. The brush, of course, is also suitable for the cleansing or scrubbing of dirty feet and toe-nails.

In keeping with these objects and with others which will become apparent hereinafter, one feature of the present invention resides, briefly stated, in a hand-scrubbing brush, in which the housing is formed as a kidney-shaped profile with one narrow side provided with a plurality of rotational bodies arranged rotatably along an arcuate or curved line adapted to the kidney shape, and a gear mechanism is provided for driving the rotational bodies by a motor in a form-and-force-locking manner.

In accordance with another feature of the present invention, the narrow side of the housing is formed as a bearing plate and a gar mechanism with the motor drive is mounted on it so that together with a removable, water tightly sealed grip sleeve, to form the housing.

In accordance with still another feature of the present invention, the grip sleeve and the bearing plate have a shape adapted to the natural arching of the palm of the human hand.

The rotational bodies can be formed so that they are pluggable into their positions.

The rotational bodies can be provided with bushings distributed in the bearing plate along two circular arc lines having different radii.

The gear mechanism can be designed so that the rotational bodies all rotate in the same direction of rotation, and the direction of rotation of the motor is reversible.

The rotational bodies can be equipped with clusters of bristles, and the clusters of bristles can be associated with neighboring brush rollers and also staggered and positioned so as to fill gaps.

The rotational bodies can be toothed or sprocket rollers which are circulated by an endless gear belt provided with bristles on the outer side.

The brush can be provided with the operational switch formed as a solenoid-operated switch with a switching magnet formed as a sliding contact.

Finally, the brush can be provided with a splash-proof enclosure which can slipped onto the grip sleeve.

The advantages which can be achieved when employing the invention are to be seen above all in the fact that there is provided a plurality of preferably cylindrical brush members disposed parallel in relation to one another both rotatably and interchangeably on a circular arc within the bearing plate of a kidney-shaped housing. The shape of the housing is adapted to the natural arching of the palm of the human hand. A gear mechanism is disposed between the driving motor and the brush members, and so designed that all brush members will rotate in the same direction. The brush rollers may be replaced by toothed or sprocket rollers via which an endless gear belt which, on its outside, is provided with bristles, is put into circulation.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

FIG. 1 shows a hand-scrubbing brush according to the invention in a perspective representation, with the brush rollers not in position, and FIG. 2 shows the hand-scrubbing brush of FIG. 1 in a different perspective representation, with the grip sleeve removed, and with the splash-proof enclosure in position.

DESCRIPTION OF THE PREFERRED EMBODIMENTS

Figure 1:
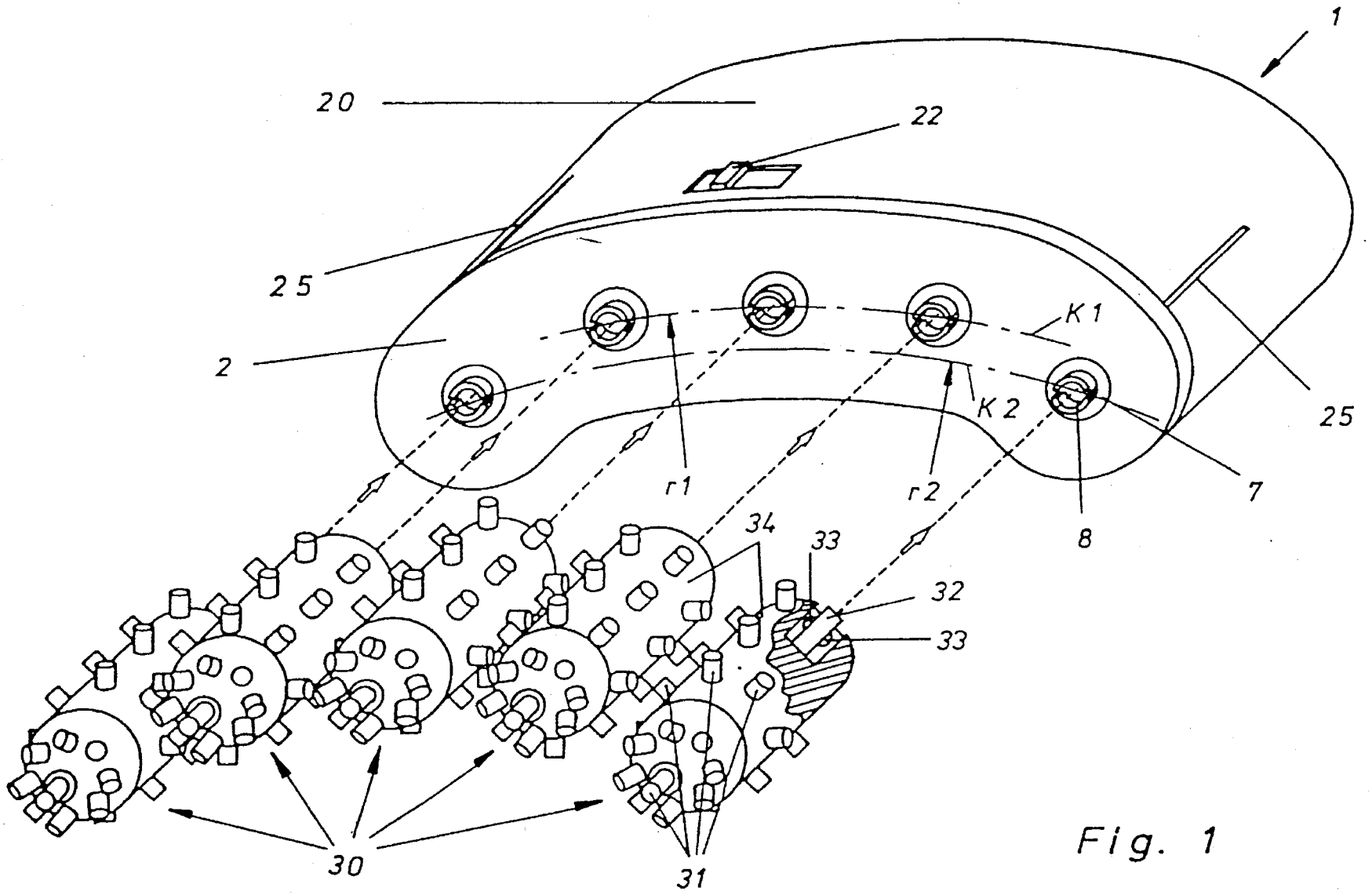

FIG. 1, in a perspective representation, shows a hand-scrubbing brush having a mains-independent motor drive. The appliance chiefly consists of a housing 1 which, as is still to be explained in greater detail hereinafter with reference to FIG. 2, encloses a DC motor 9 with a reduction gear 10, a gear belt drive 4 as well as a set of rechargeable batteries 11. The housing 1 has a kidney-shaped profile. One of its narrow sides is embodied to form a bearing plate 2 in which several shafts 8 are rotatably supported in bushes provided with shaft packings. In adaptation to the respective chosen profile of the housing 1, the bearings 7 are disposed along one of two circular arcs K1 or K2 respectively. While the three middle ones of the bearings 7 are disposed on the circular arc K1 having a radius r1, the two outer ones of the bearings 7 are disposed on the circular arc K2 having a somewhat shorter radius r2. This arrangement, when maintaining an unchanged distance between bearings, permits to design a compact appliance with the housing thereof having a kidney-shaped profile. To the shape of the plate 2 there is adapted the profile of the rearward handling grip sleeve 20 together with which it forms the housing 1. On the whole, therefore, the shape of the housing 1 is clearly adapted to the natural arching of the palm of the human hand. Into the handling grip sleeve 20 a sliding contact 22 is integrated in a water-tight manner. On the bottom side of the assembly there is mounted a switching magnet which forms part of a solenoid-operated switch. On both the right- and the left-hand sides the grip sleeve 20 is provided with each time two guide grooves 25 (of which each time only one can be recognized from the drawings). These guide grooves 25 serve to take up a splash-proof enclosure 40 (FIG. 2) in the proper position.

In order to enable the detachable reception of brush rollers 30, each of the shafts 8 has an axial blind-end bore. The shaft ends as projecting from the plate 2 are cross-slotted. The brush rollers 30 each have a pivot or journal 32 which is let into the shaft body thereof, with these pivots or journals 32 each being provided with diametrically arranged detent latches 33. In the plugged-in state the brush rollers 30, via their pivots or journals 32, are each axially guided in the blind-end bores of the respective shafts 8, with the lateral nose members 33 lockingly engaging the cross-slots of the shafts 8, thus effecting a form-fitting interlock connection.

As is easily recognizable from FIG. 1 of the drawings, the brush rollers 30 are provided with a plurality of bristle clusters 31 disposed along the circumference as well as on the end faces thereof. The divisional spacing between the shafts 8 is only somewhat larger than the diameter of the individual brush-roller body 34. The clusters or bunches of bristles 31 of neighbouring brush rollers 30, therefore, are staggered and positioned so as to fill gaps.

Figure 2:
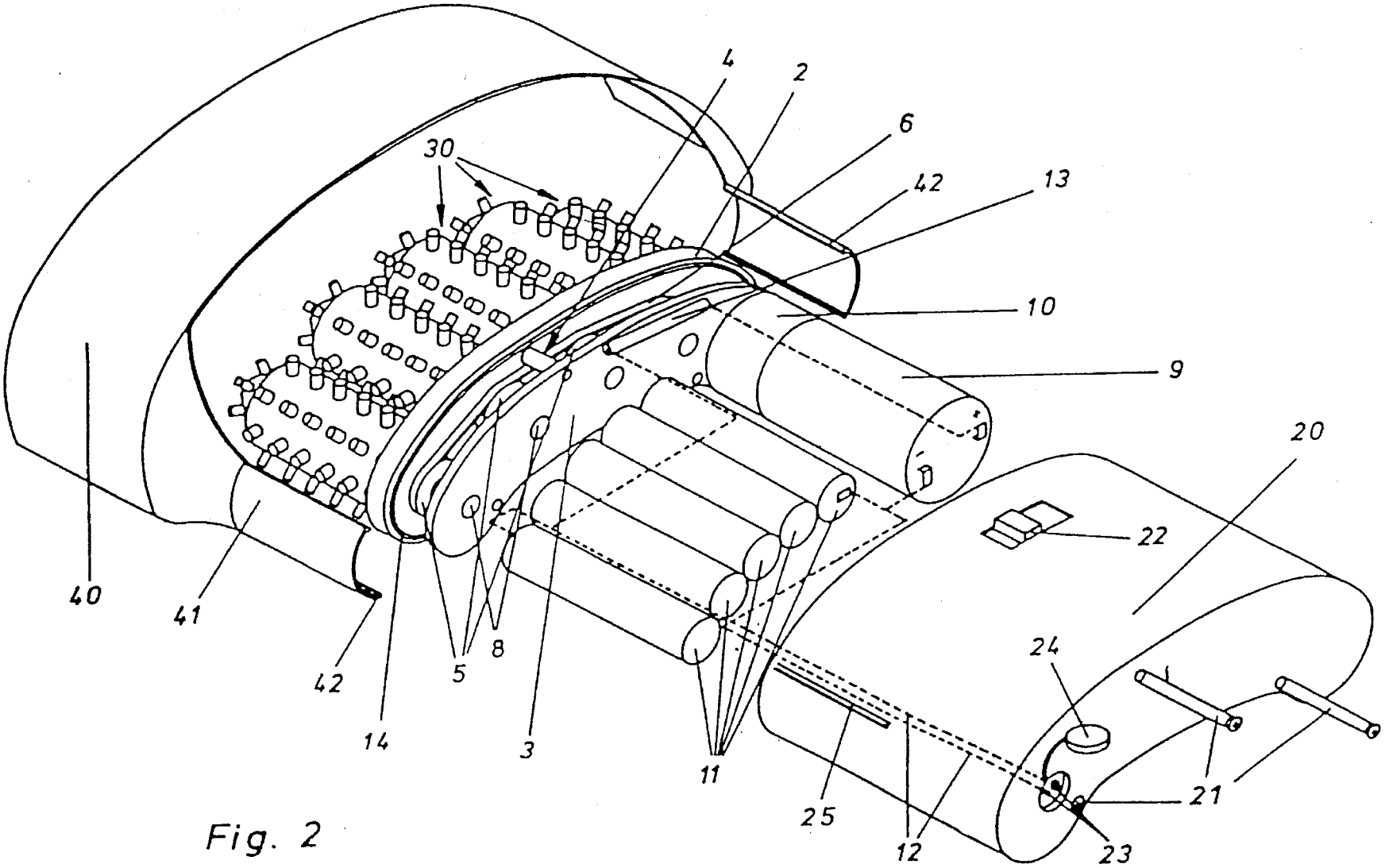

FIG. 2 shows the hand-scrubbing brush of FIG. 1 in a different perspective representation with the grip sleeve 20 removed, thus permitting that part of the appliance to become visible which is normally hidden behind the protective grip sleeve 20. On the inside and parallel in relation to the bearing plate 2 there is disposed a gear plate 3. In this gear plate 3 the shafts 8 are rotatably supported with their rearward ends. On each of the shafts 8 a gear-belt pulley 5 is firmly arranged. The DC motor 9 which is designed to form one unit together with a reduction gear 10, is flanged to the aforementioned gear plate 3. The driving shaft (which is not visible from the drawing) projects into the space between the two plates 2 and 3 and carries on its end the gear-belt pulley 5. Via a gear belt 6 which is in a form-locking connection and in engagement with all of said gear-belt pulleys 5, the shafts 8 and, consequently, the brush rollers 30 thereon, are driven by the motor 9 in the same direction of rotation.

The current for the motor 9 is supplied by a set of rechargeable batteries 11 which, for providing the necessary voltage, are series-connected in a not particularly shown manner. Included in the circuit is a magnetic contact 13 which, when the grip sleeve 20 is in position, is capable of being operated non-contactingly via the switching magnet as mounted to the slider 22. The grip sleeve 20 also includes a charging socket 23 which, via electrical lines 12, is in connection with the batteries 11 and is thus capable of being connected to an external battery charger. This charging socket 23 can be protected against splashwater by providing a protective cover or cap 24. The slipped-on grip sleeve 20 is retained in position with the aid of the screws 21. A packing ring 14 let into the circumferential groove of the bearing plate 2 takes care of sealing the grip sleeve 20 with respect to the plate 2.

In order to protect the user from the splashwater of the rotating brush rollers 30 there is provided a splash-proof enclosure 40 which is intended to cover up that particular side of the hand scrubbing brush which is just not in use. For this particular purpose the splash-proof enclosure 40 can be re-positioned as required. Corresponding to the guide grooves 25 of the grip sleeve 20, also the splash-proof enclosure 40 has two guide members 41 which are disposed at a distance corresponding to the clear width of the grip sleeve 20 and are formed in accordance with the outer contours of the grip sleeve 20 within the area of the guide grooves 25 as pairwisely provided for therebetween. The longitudinal edges of the guide members 41 are designed as strip-shaped engaging elements 42. In the plugged-in condition the engaging elements 42 formlockingly engage into the guide grooves 25 as provided for in the grip sleeve 20 thus ensuring the splash-proof enclosure 40 to be firmly retained in position.

According to a modified embodiment, the brush rollers 30 may also be replaced by toothed or sprocket rollers which are put into circulation by an endless gear belt which is provided with bristles on its outer side. Within the area of the concave arching the gear belt is freely tensioned. In this way it can adapt itself to the unevennesses of the human hand to be scrubbed or cleansed.

In order to achieve a scrubbing or cleansing effect to be improved in the individual case it might be desirable to change the direction of rotation of either the brush rollers 30 or the gear belt provided with bristles. This may be accomplished in a simple way by effecting a polarity reversal of the DC motor 9, e.g. via a second solenoid-operated switch designed to operate as a changeover switch.

It will be understood that each of the elements described above, or two or more together, may also find a useful application in other types of constructions differing from the types described above.

While the invention has been illustrated and described as embodied in a hand-scrubbing brush comprising a mains-independent motor drive, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hand-scrubbing brush, comprising drive means; a housing accommodating said drive means, said housing having a kidney-shaped profile with two opposite kidney-shaped sides; a plurality of rotational bodies equipped with bristles and rotatably mounted on one of said kidney-shaped sides of said housing along a line adapted to a kidney shape of said profile; and means for transmitting movement of said drive means to said rotational bodies so as to drive said rotational bodies in form-locking and force-locking manner.

2. A hand-scrubbing brush as defined in claim 1, wherein said drive means is a motor drive.

3. A hand-scrubbing brush as defined in claim 1, wherein said housing is a water-tight housing.

4. A hand-scrubbing brush as defined in claim 1; and further comprising an operating switch integrated in said housing.

5. A hand-scrubbing brush as defined in claim 1, wherein said rotational body is arranged on said line formed as an arcuate line.

6. A hand-scrubbing brush as defined in claim 1, wherein said rotational body is arranged on said line formed as an curved line.

7. A hand-scrubbing brush as defined in claim 1, wherein said transmitting means is formed as a gear mechanism.

8. A hand-scrubbing brush as defined in claim 7, wherein said gear mechanism is formed so that said rotational bodies rotate in a same direction of rotation, said drive means including a motor which is connected with said gear mechanism and has a reversible direction of rotation.

9. A hand-scrubbing brush as defined in claim 1, wherein said one narrow side of said housing is formed as a bearing plate, said drive means including a motor drive and said transmitting means including a gear mechanism which are mounted on said bearing plate; and further comprising a removal, water-tightly sealed grip sleeve which together with said bearing plate forms said housing.

10. A hand-scrubbing brush as defined in claim 9, wherein said grip sleeve and said bearing plate are shaped so as to adapt to a natural arching of a palm of a human hand.

11. A hand-scrubbing brush as defined in claim 9; and further comprising an operating switch integrated in said housing and formed as a solenoid-operated switch, said solenoid-operated switch having a switching magnet formed as a sliding contact disposed within said grip sleeve in a water-tight manner.

12. A hand-scrubbing brush as defined in claim 9; and further comprising a splash-proof enclose which is slippable onto said grip sleeve.

13. A hand-scrubbing brush as defined in claim 1, wherein said rotational bodies are arranged removably in said housing.

14. A hand-scrubbing brush as defined in claim 1, wherein said one narrow side of said housing is formed as a bearing plate, said rotational bodies being provided with bearing bushings distributed in said bearing plate along two circular arc lines, with a radius of a circular arc serving outer ones of said bearing bushings being smaller than a radius of a circular arc serving inner ones of said bearing bushings.

15. A hand-scrubbing brush as defined in claim 1, wherein bristles of said rotational bodies are arranged in clusters; and further comprising a plurality of brush rollers, said clusters of bristles associated with neighboring ones of said brush rollers being staggered and positioned so as to fill gaps between said brush rollers.

* * * * *